United States Patent [19]

Bresson et al.

[11] 3,953,974

[45] May 4, 1976

[54] IMPERVIOUS BARRIER COMPRISING POLYOLEFIN FABRIC, ASPHALT AND ASBESTOS

[75] Inventors: Clarence R. Bresson; Forrest D. Spaulding, both of Bartlesville, Okla.

[73] Assignee: Phillips Petroleum Company, Bartlesville, Okla.

[22] Filed: Oct. 31, 1974

[21] Appl. No.: 519,693

Related U.S. Application Data

[62] Division of Ser. No. 207,800, Dec. 14, 1971, Pat. No. 3,864,157.

[52] U.S. Cl. ..... 61/1 R; 52/169 R; 61/7; 137/236; 428/288; 428/291; 428/296; 428/300; 428/301; 428/302; 428/361; 428/409; 428/443; 428/489; 428/500

[51] Int. Cl.[2] ..... B32B 5/14; B32B 11/02; B32B 11/10; E02B 5/02

[58] Field of Search ..... 117/138.8 E, 168, 126 AQ; 161/82, 154, 155, 156, 164, 170, 205, 150, 236, 247; 106/282; 61/1 R, 7; 428/272, 288, 291, 296, 300, 301, 302, 361, 409, 443, 489, 500; 52/169; 137/236

[56] References Cited

UNITED STATES PATENTS

| | | | |
|---|---|---|---|
| 2,733,159 | 1/1956 | Scoggin et al. | 117/126 AQ |
| 3,474,625 | 10/1969 | Draper | 61/1 |
| 3,505,260 | 4/1970 | Woodruff | 106/282 |
| 3,632,415 | 1/1972 | Franklin | 161/170 |
| 3,864,157 | 2/1975 | Bresson et al. | 161/164 |

*Primary Examiner*—J. C. Cannon

[57] ABSTRACT

An impervious cover structure is produced by laying a polyolefin fabric fused on one side only, fused side against the surface to be covered, and the unfused side is coated with a mixture containing asphalt and asbestos fibers.

9 Claims, 1 Drawing Figure

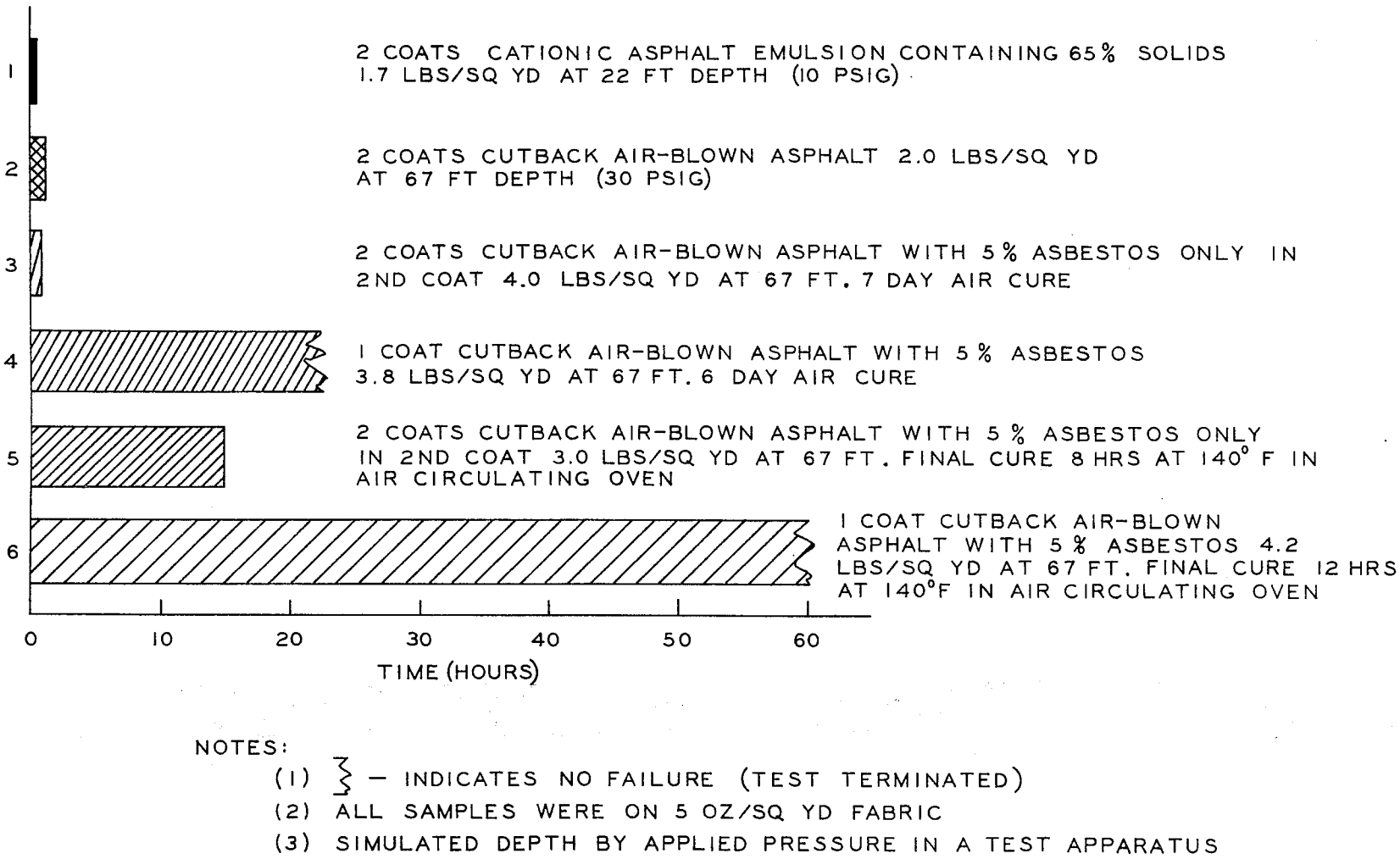
NOTES:
(1) ⌇ — INDICATES NO FAILURE (TEST TERMINATED)
(2) ALL SAMPLES WERE ON 5 OZ/SQ YD FABRIC
(3) SIMULATED DEPTH BY APPLIED PRESSURE IN A TEST APPARATUS

IMPERVIOUS BARRIER COMPRISING POLYOLEFIN FABRIC, ASPHALT AND ASBESTOS

This is a division of our copending application Ser. No. 207,800, filed Dec. 14, 1971, entitled "Impervious Barrier Comprising Polyolefin Fabric, Asphalt and Asbestos" and now Pat. No. 3,864,157.

This invention relates to an impervious cover structure. In one of its aspects, it relates to a cover structure comprising a polyolefin fabric, asphalt and asbestos fibers. In another of its aspects, the invention comprises a surface or object to which has been applied an impervious cover structure comprising a polyolefin, for example, a nonwoven polyolefin fabric, mat, or web, the polyolefin being impregnated with a mixture containing asphalt and asbestos fibers. It also relates to a method for producing covers or coatings as described herein. Further, in a specific aspect, the invention relates to a reservoir of pond or other container which is rendered fluid retentive by applying thereto an impervious cover structure according to the invention.

In one of its concepts, the invention provides a cover structure which is produced by fusing externally on one side, or at least on one side, a polyolefin fabric, mat, or web, laying said fabric, mat, or web with its fused side against an object surface or ground to be rendered impervious and then coating said fabric, mat, or web on a provided unfused external side with a mixture containing asphalt and asbestos fibers.

In another of its concepts, the invention provides a reservoir, container or pond having a liner or structure applied to the surface thereof as herein described.

Various liners have been provided for covering objects or surfaces or the ground to render these impervious to fluids, for example, to water, or other liquids. In places at which the fluid or liquid exerts considerable pressure against the covering structure or liner, leakage is often observed. This leakage occurs at so-called pin hole openings in the coating or covering structure. These leaks have been observed, particularly with nonwoven fabrics which have been coated with various sealants. Thus, in fairly deep pond liner applications, it has been observed that asphalt sealed nonwoven polypropylene fabric can develop pin hole leaks which may be due to cold flow.

We have now conceived of an improved cover structure. Thus, we have conceived that if the nonwoven fabric is provided with a fused external side and a nonfused external side, and is laid fused side against the object to be covered or fused side down on the ground as in the lining of a pond and is then covered or coated with asphalt-containing asbestos fibers, as further described herein, the resulting structure will not develop leaks.

An object of the invention is to provide a cover structure. A further object of the invention is to provide a fluid or liquid impervious cover structure suitable for application to objects to be protected against fluid or liquid. A further object of the invention is to provide a liner for liquid storage ponds. A still further object of the invention is to provide a cover structure of improved character in that it will withstand liquid pressure of considerable magnitude, yet not develop leaks. A further object of the invention is to provide a cover structure comprising a nonwoven fabric covered with asphalt which will not flow, once cured, due to cold flow through "windows" in the nonwoven fabric.

Other aspects, concepts, objects, and the several advantages of this invention are apparent from this disclosure, drawing, and the appended claims.

According to the invention, there if provided an impervious cover structure which comprises a nonwoven polyolefin fabric, mat, or web, fused externally on one side and having unfused fiber on the other external side thereof, the fused side being laid against the material to be covered, the unfused fibrous side being coated with a mixture containing asphalt and asbestos fibers.

The asphalt-asbestos mixture which is applied is usually applied as a cut-back asphalt. The cut-back asphalt is prepared from an air-blown asphaltic material having a penetration of about 20–50, preferably 25–35, a minimum ductility at 77°F of 5, and a Ring and Ball softening temperature of 160°–175°F.

The cut-back solvent used to prepare the cut-back asphalt is selected from kerosene, cycle oil, Stoddard solvent, or, in general, a hydrocarbon based material having an initial boiling point in the range of 160°–450°F, preferably 200°–300°F.

Sufficient cut-back oil is used to make the resultant blend applicable to the surface by hot application not exceeding about 250°F (melting point of polypropylene) at a temperature which will not adversely melt the fabric or by spray or brush technique at ambient temperatures. Usually about 20–100 parts by weight of solvent, preferably about 40–70 parts by weight per 100 parts by weight of asphaltic material, are used.

The asbestos fiber is added to the cut-back asphalt in amounts from about 4–10 parts/100 parts by weight of cut-back asphalt. It can have a fiber length of about 0.01–0.1 inch, preferably about 0.03–0.06 inch. While the presence of longer fibers can be tolerated, the preferred range is more readily handled by the usual equipment and best improves the desirable properties of the asphalt, such as the penetration values.

It has been found that using an approximately 4 oz/yd$^2$ fabric, an asbestos fiber content of about 6–8, or more, parts/100 parts of cut-back asphalt is preferred, while for a 5-oz. web a fiber content of about 5–6 in the cut-back asphalt is sufficient.

The fabric is made from about 2–20 denier, preferably about 3–8 denier crimped staple about ½ to about 3 inches long; a batt of these fibers is needle punched by conventional means and the needle-punched fabric is then passed through a pair of nip rolls, one of which is heated above the melting point of the fibers to heat-fuse the fibers on one side. The amount of fusion is adjusted to give the final product a tensile strength of from about 10 lbs. to about 75 lbs./inch of width, the strength depending both on the amount of fusion, weight of fabric, and denier of the fiber. The fabric is about 1–5 mm thick under no compression and ordinarily less than about 10 percent of the thickness of the fabric is fused.

The polypropylene fabric should have a weight of at least about 3.5–4 oz/yd$^2$ and is fused on one side only. A heavier fabric weighing about 5–6 oz/yd$^2$ is now preferred. Much heavier fabrics become uneconomical and heavy to handle.

A capped product, i.e., a light fabric fused on both sides, having a "cap" of 1–2 oz/yd$^2$ of additional fiber, e.g., nylon, attached to one side thereof by an added needle punch operation and having a total weight between about 4.0 and about 5.5 oz/sq yard is also suitable. The added fiber now acts as does the unfused side of the fabric which is fused on one side only. Thus, the capped side is the one to which the cut-back asphalt/asbestos mixture is applied.

It is obvious that there are a number of variables which coact to provide an effective leak-proof liner. Under mild conditions, for example, a shallow, sweet water pit or ditch, an asphalt with higher penetration can be used and a more fluid cut-back formulation containing less asphalt can be used. For more severe conditions, deep water, higher temperature and brine, for example, a lower penetration asphalt is used with a heavier mat and more asbestos; this more viscous material may have to be applied hot (v.s.). These and other variables can be determined by mere routine testing by one skilled in the art in possession of this disclosure.

It is essential, however, that the asbestos fibers in the mixture be forced by the flow of the liquid through the mat into immediate contact with the surface of the mat where they become imbedded in the unconsolidated top surface of the fabric and lodge in the interstitial voids present therein.

The bar graphs in the FIGURE reflects results obtained without and by using the invention. These are comparable.

Referring now to the bar graph, the bars indicate by their lengths the time in hours at certain pressures required for failure of the cover structure indicated.

The pressure was applied in a test apparatus into which water was fed and maintained under pressure against the test covered structure supported on a screen.

There are six tests shown in the bar graph. Failure or end of test with failure is indicated by the bars which have smooth or straight line endings. The cut-away endings in tests 4 and 6 indicate that the tests were still under way at the indicated time in hours.

The final oven cure for tests 5 and 6 was for 8 and 12 hours at 140°F in an air circulating oven, respectively.

It can be seen that one coat covering with cut-back asphalt containing asbestos according to the invention yields results which are far superior to those obtained even with two coats of covering when the asbestos is only in the second coat. Thus, the tests demonstrate a coaction between the asbestos in the asphalt and the fabric to which it is applied.

It will be evident to one skilled in the art in possession of this disclosure and having studied the same that there must needs be, according to the invention, loose or unfused fibers on the external surface of the fabric to which the asphalt-asbestos mixture is applied. Thus, is it within the scope of the invention to use a fabric which has been fused on both sides but to which there has been applied additional fiber in some manner or other as by a needle punch operation.

The asbestos fiber now preferred is Johns-Manville 7MO2 fibers. These asbestos fibers were used in the specific tests reported in the bar graphs. The fabric used was a nonwoven polypropylene five ounce per square yard fabric, heat-fused on one side. This fabric is now preferred. The mixture of asphalt-asbestos and solvent should be readily sprayable at temperatures of 120°–180°F and as such can be applied to vertical surfaces as well as horizontal ones. Application in addition to those described are various. Various shaped objects in addition to ponds can be covered. Inside of tanks of various shapes can be covered. Rooftops, especially those which may be structured to accumulate and to retain liquid as a shield against heat can also be covered. Indeed, though the structure of the invention is particularly well suited for use under considerable hydrostatic pressure, it can, of course, be used in all those places where fabric reinforced asphalt containing coverings are used.

The following examples include data from which the bar graph has been prepared, as well as other data.

EXAMPLE I

Polypropylene fibers of staple length, about 6 denier, were carded and needle-punched to a consolidated fibrous batt. The batt was subjected to a heating step in which it was passed through a pair of nip rolls, one of which is heated to about 400°F to fuse the fibers on that side. The resulting nonwoven fabric has a weight of about 5 oz/yd$^2$ and an average thickness of about 2 mm.

PREPARATION OF CUT-BACK ASPHALT/ASBESTOS MIX

The cut-back asphalt was prepared from an air blown asphaltic material having a penetration of 35, a ductility at 77°F of 5, and a Ring and Ball softening temperature of 165°F. The asphalt was cut back with naphtha, boiling range 200°–400°F, at a ratio of 100 parts of asphalt and 50 parts of naphtha. To this blend were added asbestos fibers with an average fiber length of about 0.05 inch. Sufficient fibers were added to provide about 5 parts by weight asbestos fibers in 100 parts of cut-back asphalt.

TEST PROCEDURE

A sample of the nonwoven fabric (5 oz/sq yd) was spray-coated with the cut-back asphalt containing five percent asbestos fibers at a rate of ⅔ gal/yd$^2$ and allowed to cure for 12 hours at 140°F in a hot air oven. The fabric had no pin holes and was an effective hydraulic barrier at 67 feet at 80°F. The test was carried out in a static load apparatus in which a sample fabric is subjected to a static hydraulic load at a controlled temperature and the time measured to develop a leak. This sample was tested for 60 hours without failure when the test was discontinued.

EXAMPLES II–V

Other samples of 5 oz/yd$^2$ fabric were variously treated and tested as in Example I.

1. Single coats of a cationic asphalt emulsion were applied on two consecutive days and then allowed to cure in air at ambient temperature for one week. The sample failed under 10 psi load after about six minutes.
2. Two coats of air-blown, cut-back asphalt (2.0 lbs. asphalt/sq yd) without asbestos fibers on fabric samples were tested at 30 psi (67 ft.) and failed after 60 minutes.
3. Two coats of air-blown cut-back asphalt were applied, the first coat without asbestos fibers and after a one-day cure the second coat containing 5 parts asbestos fibers/100 parts of cut-back asphalt (4.0 lbs. asphalt/sq yd). This sample failed after 45 minutes (7-day air cure).
4. One coat air-blown cut-back asphalt with 5 parts asbestos fibers/100 parts cut-back asphalt (3.08 lbs/sq yd), 7-day air cure. The sample did not fail after 22 hours at 30 psi (67 ft.) when test was terminated.

EXAMPLE VI

Samples of 4-oz. nonwoven fabric fused on one side were coated with a cut-back asphalt containing 5 and 7 parts by weight of asbestos fibers per 100 parts of cut-back asphalt, respectively, cured and tested as before.

The 4-azo material coated with the 5/100 mixture failed after five hours while with the 7/100 mixture the test was discontinued at 95 hours without failure.

EXAMPLE VII

A nonwoven fabric was prepared by carding and needle-punching 6-denier polypropylene staple and then about 1½ oz/sq yd nylon 66 staple was needle-punched into the batt and the polypropylene side was fused. This nylon capped fabric had an approximate weight of 5½ oz/sq yd.

A sample of this material was coated with ⅔ gallon/sq yd of 5/100 asbestos cut-back asphalt mixture and allowed to cure for eight days. Under hydraulic test at 80°F and 30 psi (67 ft) no failure occured after 130 hours when the test was discontinued.

EXAMPLE VIII

A similar capped coated fabric was prepared, except that 6-denier polypropylene fiber was substituted for the nylon of Example VII. One coat of 5/100 asbestos-/asphalt (½ gallon/sq yd) mix was applied as in Example VII, and the cured fabric was tested at 80°F and 30 psi (67 ft). No failure had occurred after 25 hours when the test was discontinued.

It is evident from Example I that the spray coated fabric which had been cured was free from pin holes and was an effective barrier against hydraulic pressure for a period of 60 hours.

In Examples II–V, it is shown that (1) single coating asphalt emulsion applied on two consecutive days or (2) single coats of cut-back asphalt applied on two consecutive days failed to provide an effective barrier under comparative conditions. Also application of a first coat (3) without and a second coat with asbestos fibers likewise failed to provide a suitable barrier. A single coating including asbestos fibers (4) provided such a barrier.

Examples VII and VIII show the use of a capped fabric, that is, a fabric which has a coating of, say, nylon or polypropylene thereon. These fabrics also produce excellent test results against hydraulic pressure.

Reasonable variation and modification are possible within the scope of the foregoing disclosure and the appended claims of the invention, the essence of which is that there has been set forth an impervious cover structure which comprises a nonwoven polyolefin fabric, mat or web fused externally on one side and placed with that side against a surface or area to be protected or rendered impervious and then covering the other side on which the surface fibers are unfused with a mixture containing asphalt and asbestos fibers, substantially as described.

We claim:

1. A fluid retentive container comprising a supporting mass lined with an impervious cover structure which comprises a nonwoven polyolefin fabric, mat or web, fused externally on one side and placed with that side against said mass and having unfused fiber on the other external side, the unfused fibrous side being coated with a mixture containing asphalt and asbestos fibers.

2. A structure according to claim 1 wherein the polyolefin is polypropylene.

3. A storage pit, pond or reservoir comprising as a liner extending over its inner walls an impervious cover structure according to claim 1.

4. A storage container or tank adapted to contain a liquid having therein on its walls to protect its walls against loss of fluid an impervious cover structure according to claim 1.

5. A structure according to claim 1 wherein the polyolefin is polypropylene and the fabric has a weight in the approximate range of about 3–8 ounces per square yard and the asbestos fiber has an average length of from about 0.01 to about 0.1 inches.

6. A cover structure according to claim 1 wherein said fabric is a needle punched fabric having a weight in the approximate range of about 3–8 oz/yd2 and containing crimped staple of about 2–20 denier and about ½ to about 3 inches long, a tensile strength of about 10–75 lbs./inch of width, and a thickness of about 1–5 mm with the fused side being less than about 10 percent of the thickness of the fabric.

7. A cover structure according to claim 1 wherein said asphalt has a penetration of about 20–50, a minimum ductility at 77°F of about 5, and a Ring and Ball softening temperature of about 160–175°F, and wherein said asbestos fibers have a fiber length of about 0.01–0.1 inch and are present in said mixture in an amount of about 4–10 parts/100 parts by weight of asphalt.

8. A cover structure according to claim 1 wherein the fabric was made by fusing both major faces of a nonwoven polyolefin fabric, mat or web, thereafter capping one of the fused faces with a layer of unfused fibers, and then coating the layer of unfused fibers with a mixture of asphalt and asbestos fibers.

9. A cover structure according to claim 8 wherein the capping is nylon or polypropylene fibers added by a needle punch operation.

* * * * *